US005547719A

United States Patent [19]

Diehl

[11] Patent Number: 5,547,719

[45] Date of Patent: Aug. 20, 1996

[54] IMITATION CEREMONIAL RICE

[76] Inventor: Joel C. Diehl, 2404 Manana, Austin, Tex. 78730

[21] Appl. No.: 35,083

[22] Filed: Mar. 22, 1993

[51] Int. Cl.[6] ..... A41G 1/00; A47G 33/00

[52] U.S. Cl. ..... 428/15; 426/104

[58] Field of Search ..... 428/15; 426/104

[56] References Cited

U.S. PATENT DOCUMENTS

| | | | |
|---|---|---|---|
| 3,620,762 | 11/1971 | Yoshida et al. | 426/626 |
| 3,628,966 | 12/1971 | Katsuya | 426/302 |
| 3,711,295 | 1/1973 | Zukerman | 426/618 |
| 3,980,009 | 9/1976 | Petersen | 99/353 |
| 3,988,484 | 10/1976 | Shatila | 426/99 |
| 4,325,976 | 4/1982 | Harrow et al. | 426/104 |
| 4,435,435 | 3/1984 | Hsu | 426/557 |
| 4,585,664 | 4/1986 | Kohlwey | 426/619 |
| 4,794,012 | 12/1988 | Taniguchi et al. | 426/462 |

*Primary Examiner*—Henry F. Epstein
*Attorney, Agent, or Firm*—Anthony V. S. England

[57] ABSTRACT

A water soluble, quickly degrading imitation rice, which is not harmful to birds and will not germinate, for use in ceremonies such as weddings. The invention is produced by combining binders with digestible solids, extruding the mixture, and cutting to the approximate size and tapered shape of natural rice grains. The invention is produced in a natural rice color, or in other decorative colors as desired.

7 Claims, 1 Drawing Sheet

IMITATION CEREMONIAL RICE

BACKGROUND—FIELD OF INVENTION

This invention relates to imitation rice, specifically to an imitation rice for use in accordance with the traditional uses of rice in purity and fertility rites during weddings.

BACKGROUND—DESCRIPTION OF PRIOR ART

In the past it has been the tradition for guests at weddings to toss rice onto a newly married bride and groom as a symbol of purity and a rite of fertility. However, it has recently become widely accepted that rice is harmful to some species of small birds. Rice also becomes difficult to clean up after getting damp from a light rain or dew, as it tends to stick to the sidewalks which makes sweeping difficult. When swept off into the grass, rice that is not eaten by birds tends to build up at the edge of the lawn, as it does not degrade quickly. Under some conditions rice will actually germinate. This is also an unwelcome occurrence at many facilities maintaining highly manicured grounds.

The perception that rice is harmful to birds combined with cleanup problems has caused rice to be banned from use in weddings at many churches and reception facilities. As an alternative many brides began providing bird seed for guests to toss after the wedding. Unfortunately, the use of bird seed introduced a number of new problems. Because of it's shape, hardness and waxy coating, birdseed proved to be quite a slipping hazard to guests. This resulted in liability concerns for churches, reception sites, and host families.

Further, bird seed attracts large numbers of birds. This causes concern based on unsightliness and potential for increased corrosive effects of bird droppings on statues and architectural features at many sites. Finally bird seed has been found to grow quite vigorously between the cracks in sidewalks, and to appear as weeds in manicured lawns. All of these factors have contributed to the current trend toward discouraging or disallowing use of bird seed at wedding and reception sites.

Potpourri and rose petals have also been used as substitutes to rice. This is an alternative which is quite expensive, and while accepted at most facilities, marble and stone floors have been reported to stain when fresh rose petals are stepped on. Further, some people are allergic to some blends of potpourri or rose petals.

Though not widely used, confetti has been explored by some as a replacement for rice. However, it is perceived as litter by many and must be cleaned from lawns and streets as it does not degrade quickly.

Planners of weddings give great attention to aesthetics and details of tradition. Thus, all alternatives to rice mentioned above share the problem of not looking anything like rice.

Previous patents for imitation rice (U.S. Pat. Nos. 3,620,762 and 3,628,966, Ajinomoto Co., November and December, 1971) were focused on creating an enriched rice that could withstand washing, soaking, and cooking without losing the added nutrients. These formulations required waterproof coatings to maintain shape during cooking. Because birds do not chew food as humans do, these coatings will inhibit digestion. Further, because the main ingredient in the formulations was rice starch, the problems with stickiness and buildup would persist. Examination of supermarket shelves reveals no artificial rice for sale, and no references could be found indicating the use of artificial rice had ever been conceived as a substitute for rice in weddings. The application seems to have been completely overlooked, assuming the products were even offered for sale.

Objects and Advantages

Accordingly my invention offers solutions to the previously unsolved problems mentioned above, as well as some advantages never before realized.

First, my invention looks very similar to ordinary uncooked rice. This provides greater aesthetic appeal, as well as a greater perception of conformance with tradition.

Further, my invention:

- is not harmful to birds, or any other elements of the ecosystem;
- is actually nutritious to birds and insects if eaten;
- does not require waterproof coating which could inhibit digestion;
- dissolves easily in water, therefore it does not build up in lawns or at the edges of sidewalks;
- is not capable of germinating under any conditions;
- is less attractive to birds than bird seed;
- is of a hardness that allows it to crumble under the weight of an average person wearing a hard soled shoe, thereby reducing slipping hazards;
- does not become sticky;
- will not stain floors, sidewalks, or clothing;
- contains no ingredients known to cause allergic reactions; and
- does not have to be cleaned from lawns or streets.

A further object and advantage never before realized in this area is that my invention can easily be produced in any color or blend of colors desired by those planning a ceremony. This advantage is realized without hindering any of the objects or advantages previously asserted. Further objects and advantages will become apparent from consideration of the ensuing description.

SUMMARY

Figure 1:
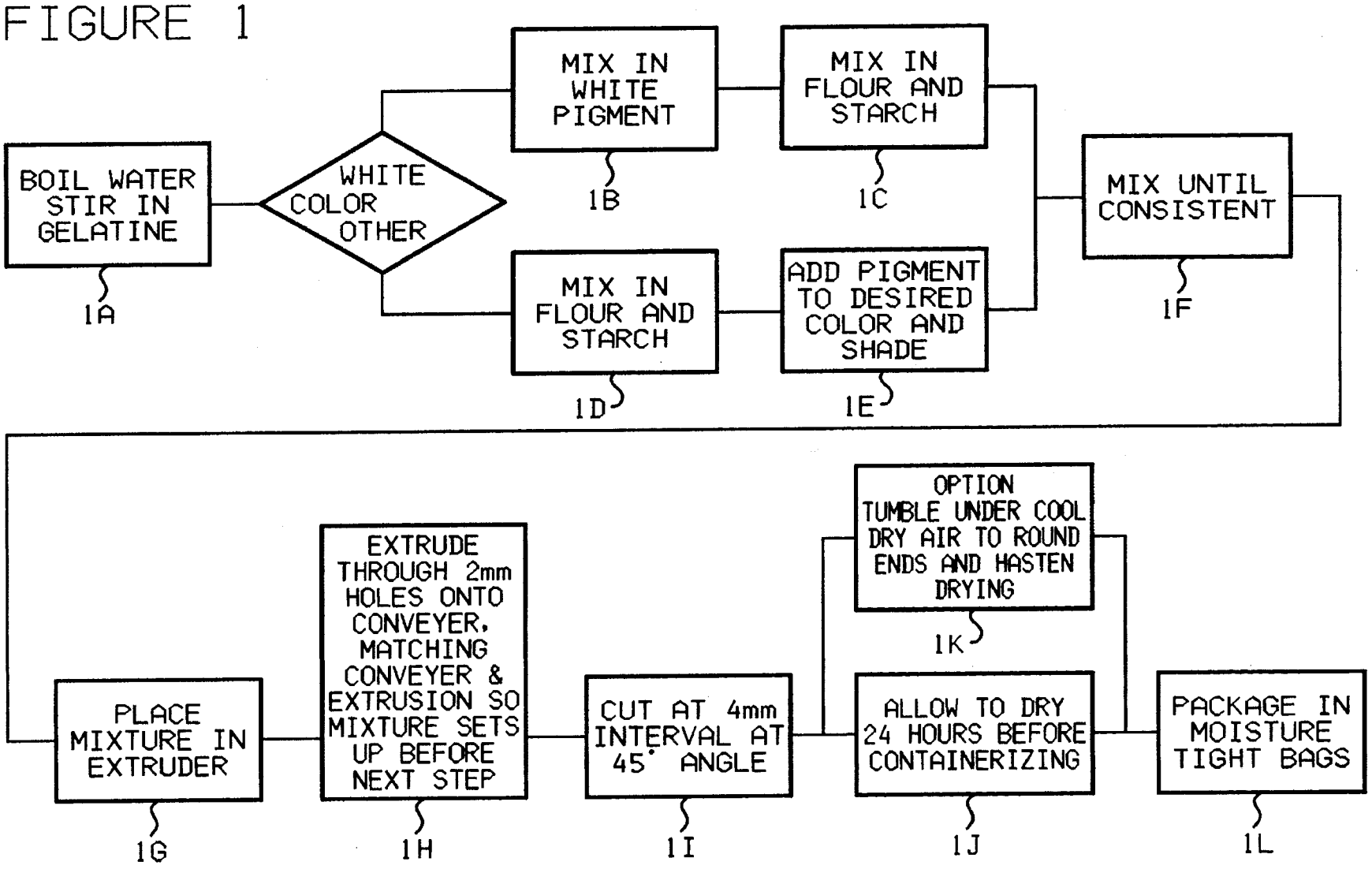
FIGS. 1-A to 1-L show a flow chart outlining the present best process used to create my invention.

The reader can now see that my invention provides a new and more desirable solution to problems that have been perceived and yet gone unsolved for a number of years.

The invention, Imitation Ceremonial Rice, is made of easily digestible materials or foodstuffs. These ingredients blended with digestible binders are then processed to appear very much like ordinary rice. The invention thereby fulfills a need with out presenting the problems associated with rice or its common substitutes. The new benefit of being able to produce the invention in a variety of colors presents an additional novelty never before realized in this area of invention.

DESCRIPTION OF INVENTION

The typical embodiment of the invention is produced according to the method outlined in FIGS. 1-A to 1-L. Beginning with FIG. 1-A, the quantity of 1¼ gallons of water is brought to a boil. ½ gallon of Type A porkskin gelatin having a bloom value of 100 to 250 (available from Knox & Kind, Souix City, Iowa) is then added and blended to an even consistency under low heat. Heat is then turned off.

Depending on the desired final color of the present batch, the steps outline in FIG. 1-B or 1-D are executed.

Assuming the desired color to be white, ½ oz. of titanium whim watercolor pigment is added (FIG. 1-B) to brighten the brownish gelatin mixture. 1 gallon of flour and ½ gallon of corn starch are then added (FIG. 1-C) and mixed until an even consistency is achieved.

Assuming the desired color to be other than white, 1 gallon of flour and ½ gallon of corn starch are then added (FIG. 1-D) and mixed until an even consistency is achieved. An appropriate amount of non-toxic water color pigment is then added to achieve the desired shade and color (FIG. 1-E).

As indicated in FIG. 1-F mixing must continue until complete blending of ingredients and consistent color is observed. The mixture is then placed in a auger-type mechanical extruder (FIG. 1-G), and forced through a row of holes 2 mm. in diameter (FIG. 1-H). A conveyer is so configured as to then receive the extruded material. The conveyer speed must be synchronized to match the rate of extrusion. The conveyer then carries the extruded material a distance of 20 feet.

Proper extruder and conveyer speed settings allow the mixture to achieve room temperature, thus setting up to a hardness which facilitates cutting and prevents irreversible clumping of finished product. Pieces are cut by an automated blade at a 45° angle upon each 4 mm interval of conveyer movement (FIG. 1-I). Thus, a finished piece dimension approximating 6 mm in length by 2 mm in diameter is achieved, with each piece having a tapered end.

Finished pieces must be allowed to dry under conditions of naturally varying ambient humidity (FIG. 1-J) for 24 hours before containerizing. As an option, (FIG. 1-K) finished pieces can be placed in a drum-type tumbling device, through which cool dry air is circulated, to hasten the drying process and further round the piece ends.

Finished, dried product must be packaged in air and moisture tight bags to prevent molding (FIG. 1-L).

OPERATION

The requirements for ceremonial use or operation of the invention are no different than those of ordinary rice. However, this invention can not be prepared for meals like ordinary rice. In fact any attempt to cook the invention will yield a thin slimy paste. This fact provides a secondary novelty use as a joke to be pulled on a skilled cook.

Although the present method for creating the preferred embodiment is detailed above, other ingredients could be substituted to yield equally operable results. For instance finely ground white corn meal could be used to replace flour. Other manufacturing methods, such as modern molding techniques, could also be used to create the desired shape. Production cost according to economies of scale would be the determining factor in making such changes, providing objects and advantages would still be attained.

CONCLUSION, RAMIFICATIONS, AND SCOPE

Imitation Ceremonial Rice can now be seen to provide all the aesthetic and traditional appeal of ordinary rice as used in ceremonies. In addition, the advantage of being digestible and nutritious to birds is offered. The additional advantages of its' inability to germinate and quick degradation also solve existing problems. Being less attractive to birds and a reduced slipping hazard are other advantages over currently used substances.

When combined with the fact that it is made of non-toxic, non-allergenic substances which will not stain floors or clothes, a unique set of advantages are provided which have never before existed in this area of invention.

The added new feature of being able to produce the invention in any color desired provides a novelty never before presented.

Thus, the reader can see that imitation ceremonial rice is a useful device which solves problems faced by many thousands of persons where no obvious solutions prevailed while providing unexpected, novel features.

While the above description contains many specificities, these should not be construed as limitations on the scope of the invention, but rather as a description of one preferred embodiment. The scope of the invention should not be determined by the described embodiment(s), but by the appended claims and their legal equivalents.

I claim:

1. A rice grain shaped product, comprising:

a dried mixture of a solid material, including a binder which tends to be soluble in water; wherein the dried mixture is digestible by birds and has a diameter and length similar to the diameter and length of a grain of rice; and wherein the product tends to dissolve in water more quickly than does rice.

2. The product of claim 1 wherein the product has an end that is tapered similar to an end of a rice grain.

3. The product of claim 2 wherein the binder solution comprises water and gelatin.

4. The product of claim 3 wherein the solid material comprises flour and starch.

5. The product of claim 4 wherein the dried mixture has compressive strength lower than the strength required to withstand a force applied by a person compressing the mixture beneath the person's weight and between the person's shoe and a hard surface.

6. The product of claim 5 further comprising a pigment for altering the color of the dried mixture.

7. The product of claim 6, wherein the diameter is approximately two millimeters, and the length is approximately six millimeters.

* * * * *